US007895672B2

(12) United States Patent
Grey

(10) Patent No.: US 7,895,672 B2
(45) Date of Patent: Mar. 1, 2011

(54) BONNET WITH SPANDEX ELASTIC STRIP

(76) Inventor: Gary Grey, New York, NY (US)

( * ) Notice: Subject to any disclaimer, the term of this patent is extended or adjusted under 35 U.S.C. 154(b) by 0 days.

(21) Appl. No.: 11/805,208

(22) Filed: May 22, 2007

(65) Prior Publication Data

US 2008/0289081 A1 Nov. 27, 2008

(51) Int. Cl.
*A42B 1/00* (2006.01)

(52) U.S. Cl. ..... 2/204; 2/410; 2/171

(58) Field of Classification Search ..... 2/204, 2/410, 171, 181
See application file for complete search history.

(56) References Cited

U.S. PATENT DOCUMENTS

| | | | | |
|---|---|---|---|---|
| 2,255,708 | A | 9/1940 | Laughton | |
| 2,983,925 | A | 8/1960 | Gettinger | |
| 4,599,749 | A * | 7/1986 | Childs et al. | 2/204 |
| 5,249,308 | A * | 10/1993 | Blume | 2/174 |
| 5,592,936 | A * | 1/1997 | Thomas, Jr. et al. | 128/206.12 |
| 6,499,144 | B1 * | 12/2002 | Yan | 2/181.2 |
| 6,665,876 | B1 * | 12/2003 | Newman | 2/59 |
| 7,020,900 | B2 * | 4/2006 | Ngan | 2/181 |
| 2002/0157168 | A1 * | 10/2002 | Andrews | 2/207 |
| 2003/0037365 | A1 * | 2/2003 | Wilson | 2/181 |
| 2005/0160518 | A1 * | 7/2005 | Cho | 2/181 |

OTHER PUBLICATIONS

Betty Dain Creations, Inc. Catalog Page—dated: Dec. 30, 2002.

* cited by examiner

*Primary Examiner*—Gary L Welch
*Assistant Examiner*—Alissa J Tompkins
(74) *Attorney, Agent, or Firm*—Sills Cummis & Gross P.C.

(57) ABSTRACT

A head covering bonnet with an opening for the head and an elastic spandex band below the opening for holding the bonnet to the head. The spandex band is of a width so as not to apply high localized pressure on the hair, and spandex is not rough or abrasive when stretched, unlike typical elastic material which becomes rough and possibly abrasive to hair when the elastic is stretched.

3 Claims, 1 Drawing Sheet

BONNET WITH SPANDEX ELASTIC STRIP

BACKGROUND OF THE INVENTION

The present invention relates to a bonnet with an elastic strip and more particularly to an improved elastic strip for a bonnet so as to preserve the hair.

Many people sleep with bonnets on their head to protect their hairstyle or hairdo against becoming messed from contact and from rubbing on a pillow or sleep surface. Such bonnets may be worn while the wearer is awake to preserve the hairstyle against being messed. A typical sleep bonnet includes a bonnet covering that is shaped to extend over the head and has an opening through which the head is installed in the bonnet. In order to hold the bonnet in place on the head, a relatively narrow elastic strip is attached typically around the inside of the bonnet at or just above the opening. After the bonnet is placed on the head, the elastic strip closes the edge of the bonnet opening around the head to hold the bonnet in place.

A typical bonnet includes a strip of an elastic material. The strip of elastic material is not smooth, especially when it is stretched, because the strip then develops a rough or abrasive surface. As elastic is stretched, its material pulls apart and the surface of the elastic becomes rough.

Hair on the head, especially hair of persons of African descent, is brittle and may break when localized pressure is applied to it or it is subject to rubbing by abrasive material. Bonnets for wearing over the hair to hold a hairdo in place, such as sleep bonnets, are typically not designed to avoid a problem produced by the elastic closure strip around the opening into the bonnet. The elastic strip is narrow in width, so that it applies concentrated and higher pressure where it contacts the hair. The elastic strip is not smooth and, especially when stretched, its surface may be abrasive.

SUMMARY OF THE INVENTION

The object of the invention is to as much as possible avoid possible damage to a wearer's hair and hairdo resulting from the elastic band of a hair bonnet or a sleep bonnet.

Another object of the invention is to distribute the force that is applied by the elastic strip of the bonnet over a wider area, thereby reducing localized pressure on the hair, and to cause the elastic applied to the hair to be smooth, not rough, and not abrasive.

According to the invention, at and below the margin or edge of the opening into a bonnet, a wide spandex elastic strip is attached at the open end of the bonnet. When the spandex strip stretches, as the bonnet is placed on the head and as the strip remains stretched as the spandex strip tightens over the hair, the spandex strip does not develop a rough surface and is less abrasive than a normal elastic at the opening in the bonnet and possibly on the inside of the bonnet. Because the spandex strip is wider than a conventional non-spandex elastic strip used in a bonnet, the spandex strip does not apply as elevated localized pressure on the hair as would a conventional, narrower elastic strip. In addition, the spandex retains a smooth surface, not abrasive, when it is stretched.

DETAILED DESCRIPTION OF AN EMBODIMENT OF THE INVENTION

Figure 1:
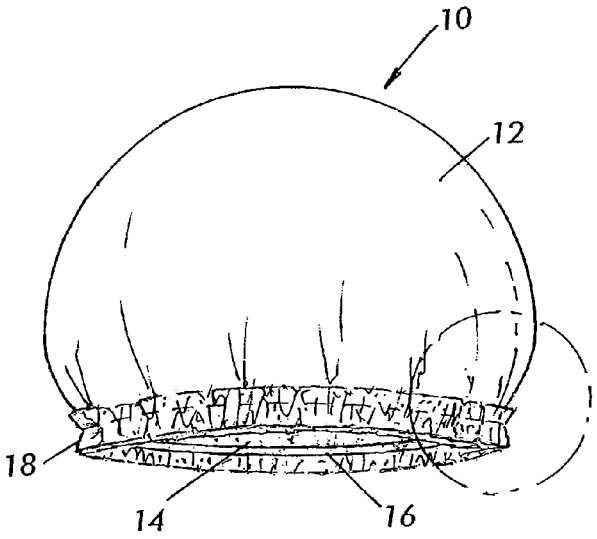
FIG. 1 PRIOR ART
FIG. 1 illustrates a sleep bonnet with an elastic strip according to the prior art.
Figure 2:
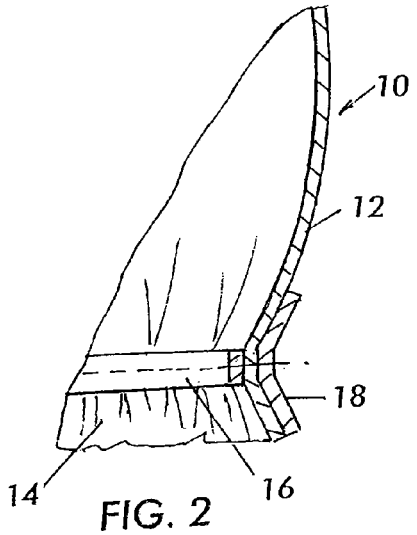
FIG. 2 PRIOR ART
FIG. 2 shows a detail thereof in cross section.

FIGS. 1 and 2 illustrate a conventional hair bonnet 10, particularly a sleep bonnet. It includes a flexible material, hair covering 12 which is generally shaped to cover a head. The bonnet is shaped to have an open end 14 into which a wearer's head is inserted. A conventional thin width elastic material strip 16 is attached to and around the open end 14 of the bonnet. Typically, the elastic strip 16 is placed on the inside of the bonnet at or slightly above the open end 14 so that the open end region is drawn tightly against the head. The illustrated strip is relatively narrow, typically being in the range of about one-quarter inch to three-quarter inch in width, and usually about one-quarter inch or one cm in width. It is typically of a material comprised of an elastic material such as a natural or synthetic rubber or latex covered with knit or braided synthetic fiber.

In addition, because the elastic strip 16 is stretchable and the open end of the bonnet expands and because the elastic strip narrows the opening when the elastic relaxes and shrinks in length, while the fabric of the bonnet covering 12 at the opening does not change size, the bonnet hair covering fabric outward of the elastic strip 16 is pleated or shirred at 18 and is not smooth, and that pleated area 18 outward of the elastic strip 16 can rub on or irregularly press on the hair.

When conventional elastic material of the strip 16 is stretched, as when the bonnet is placed on the head and while the elastic pulls the open end at 14 toward the closed condition tightened around the hair, the elastic strip 16 applies localized pressure on the hair, possibly causing breakage of the hair due to the pressure applied and also due to the not smooth and abrasive characteristic of an elastic material, particularly when it is stretched. Even if the strip is widened somewhat, its pressure may break the hair. Typically, the elastic strip is on the inside of the bonnet so that it touches the hair. While the direct contact with the roughened surface of the elastic helps hold the bonnet to the hair, it has the undesirable effect of causing breakage of hair. Also, the shirred or pleated area 18 of the bonnet outward of the elastic strip and extending both above and below the strip 16 may rub the hair and break it.

Figure 3:
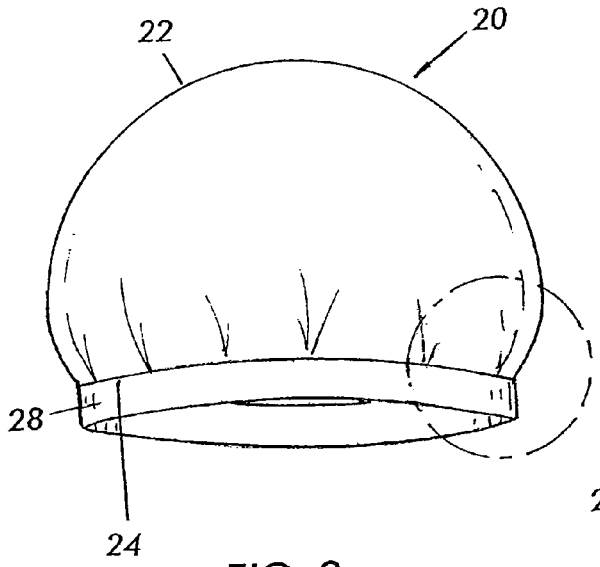
FIG. 3 illustrates a sleep bonnet with a spandex elastic strip according to the invention.
Figure 4:
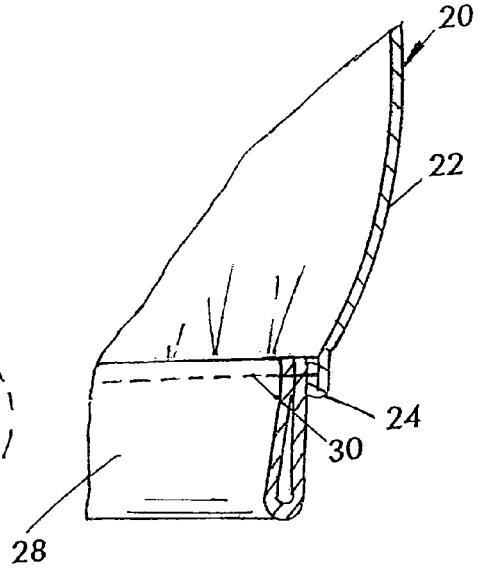
FIG. 4 shows a detail thereof in cross section.

A bonnet 20 according to the invention shown in FIGS. 3 and 4 might have the same type of head covering 22 and also has an open bottom end 24. A different spandex fiber elastic material band is attached at the open end 24 and extends below the open end to develop a separate elastic band 28, not inside the bonnet, but below it. The spandex band 28 has a width sufficient that the band does not apply a localized pressure to the hair that is likely to break the hair. For example, a minimum width of 1 inch or 2.5 cm is recommended for the spandex band and a maximum width for comfort and ability to place the bonnet on the head would generally be 2 inch or 5 cm. Spandex has the characteristic that it continuously maintains a smooth outer surface as it is stretched, so that the band has no rough surface parts that press on or can be rubbed across the hair which might cause breakage of the hair. Stretched spandex is not abrasive. Consequently, application of a spandex tightening band 28 below the open end 24 of the bonnet hair covering 22 has the beneficial effect of preserving the wearer's hairstyle and reducing, if not preventing, breakage of the hair. There is a stitch line 30 along which the band is stitched to the open end. Because the spandex band is wide, that stitch line does not press on the hair sufficiently to change the hairstyle or break the hair.

For convenience, the spandex band 28 may be doubled over on itself, as seen in FIG. 4, and the folded up free edges of the band 28 may be stitched to the bonnet at the open end 24.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A bonnet for wearing on the head, the bonnet comprising:

a head covering shaped to define an opening into the head covering, the opening shaped and sized to receive the head and having a closed and unbroken ring perimeter, the head covering at the opening having a fixed length around the perimeter of the opening, the opening being at an open bottom end of the head covering; and an elastic band doubled over on itself and attached at the open bottom end of the bonnet and positioned to encircle completely the perimeter of the opening, the elastic band having a non-stretched condition in which the band is of a shorter length around a perimeter of the opening than the fixed length of the material of the head covering at the opening such that the band reduces the size of the opening, the band being configured such that when the band with the head covering is installed on the head the band is stretched and tightens around the head, the elastic band being attached to the head covering to form an extension of the bonnet below the opening so that the band contacts the head without pressing on the head through the head covering;

wherein the elastic band is a closed and unbroken ring strip of a spandex material configured to stretch elastically and to restore itself elastically toward the non-stretched condition.

2. The bonnet of claim 1, wherein the elastic band is of a width in the range of one inch to two inches.

3. The bonnet of claim 1, wherein the elastic band below the opening comprises a material that is not abrasive or rough and when worn on the head minimizes or avoids breakage of hair contacting the material.

* * * * *